US011007629B2

(12) United States Patent
Yamamoto et al.

(10) Patent No.: US 11,007,629 B2
(45) Date of Patent: May 18, 2021

(54) GAS COMBUSTION TYPE DRIVING TOOL

(71) Applicant: MAX CO., LTD., Tokyo (JP)

(72) Inventors: Yu Yamamoto, Tokyo (JP); Takashi Yuki, Tokyo (JP); Eiichi Watanabe, Tokyo (JP); Mitsuhiro Kimura, Tokyo (JP)

(73) Assignee: MAX CO., LTD., Tokyo (JP)

( * ) Notice: Subject to any disclaimer, the term of this patent is extended or adjusted under 35 U.S.C. 154(b) by 128 days.

(21) Appl. No.: 16/251,202

(22) Filed: Jan. 18, 2019

(65) Prior Publication Data

US 2019/0224827 A1 Jul. 25, 2019

(30) Foreign Application Priority Data

Jan. 19, 2018 (JP) ..... JP2018-007520
Jan. 19, 2018 (JP) ..... JP2018-007521
Jan. 19, 2018 (JP) ..... JP2018-007633

(51) Int. Cl.

| | |
|---|---|
| ***B25D 9/16*** | (2006.01) |
| ***B25D 9/10*** | (2006.01) |
| ***B25C 1/08*** | (2006.01) |
| ***F02B 63/02*** | (2006.01) |
| *F01L 9/10* | (2021.01) |

(52) U.S. Cl.

CPC ..... *B25C 1/08* (2013.01); *B25D 9/10* (2013.01); *F02B 63/02* (2013.01); *F01L 9/10* (2021.01)

(58) Field of Classification Search

CPC .... B25C 1/08; B25D 9/10; B25D 9/16; B25D 9/26

See application file for complete search history.

(56) References Cited

U.S. PATENT DOCUMENTS

| | | | | |
|---|---|---|---|---|
| 3,850,359 A | | 11/1974 | Obergfell | |
| 4,131,164 A | * | 12/1978 | Hague | B21J 7/24 173/1 |
| 4,721,240 A | * | 1/1988 | Cotta | B25C 1/08 227/10 |
| 4,739,915 A | | 4/1988 | Cotta | |
| 6,722,550 B1 | * | 4/2004 | Ricordi | B25C 1/08 123/46 SC |

(Continued)

FOREIGN PATENT DOCUMENTS

| | | |
|---|---|---|
| JP | 50-15177 | 2/1975 |
| JP | 63-28574 A | 2/1988 |

OTHER PUBLICATIONS

European Search Report issued in Application No. 19152474.3, dated Jul. 4, 2019, 9 pages.

*Primary Examiner* — Gloria R Weeks

(74) *Attorney, Agent, or Firm* — Rothwell, Figg, Ernst & Manbeck, P.C.

(57) ABSTRACT

A gas combustion type driving tool drives a fastener by combustion pressure when mixed gas of combustible gas and compressed air in a combustion chamber is ignited. The gas combustion type driving tool includes an air ejection valve, and a gas ejection valve. The air ejection valve is configured to eject compressed air into the combustion chamber. The gas ejection valve is configured to eject combustible gas into the combustion chamber. Output related to driving of a fastener is adjustable by adjusting at least one of filling pressure of compressed air or filling pressure of combustible gas.

14 Claims, 10 Drawing Sheets

(56) References Cited

U.S. PATENT DOCUMENTS

| | | | | |
|---|---|---|---|---|
| 8,544,710 | B2 * | 10/2013 | Tanaka | B25C 1/08 227/10 |
| 2004/0134961 | A1 | 7/2004 | Wolf et al. | |
| 2004/0182337 | A1 * | 9/2004 | Schiestl | B25C 1/08 123/46 SC |
| 2004/0231865 | A1 * | 11/2004 | Giardino | B25B 21/02 173/1 |
| 2010/0116865 | A1 * | 5/2010 | Ogawa | B25C 1/047 227/130 |
| 2011/0315737 | A1 * | 12/2011 | Hamilton | B25D 9/20 227/10 |
| 2012/0153003 | A1 * | 6/2012 | Dittrich | B25C 1/08 227/10 |
| 2016/0144496 | A1 * | 5/2016 | Raggl | B25C 1/08 29/432 |
| 2019/0224828 | A1 * | 7/2019 | Watanabe | F02B 63/02 |

* cited by examiner

| POWER | OPERATING TIME OF GAS EJECTION VALVE | OPERATING TIME OF AIR EJECTION VALVE |
|---|---|---|
| HIGH | 1. 2 | 1. 2 |
| MEDIUM | 1 | 1 |
| LOW | 0. 7 | 0. 7 |

GAS COMBUSTION TYPE DRIVING TOOL

CROSS-REFERENCE TO RELATED APPLICATIONS

This application is based on and claims priority under 35 USC 119 from Japanese Patent Application Nos. 2018-007520 filed on Jan. 19, 2018, 2018-007521 filed on Jan. 19, 2018, and 2018-007633 filed on Jan. 19, 2018, the contents of which are incorporated herein by reference.

TECHNICAL FIELD

The present invention relates to a gas combustion type driving tool that drives a fastener by combustion pressure of combustible gas.

BACKGROUND ART

A gas combustion type driving tool that drives a fastener by combustion pressure of combustible gas is known in the related art. As a method for improving output of such a gas combustion type driving tool, there is an idea that a fastener is driven out by combustion pressure when mixed gas of combustible gas and compressed air is ignited. That is, although air and combustible gas are mixed in the gas combustion type driving tool in the related art, it is studied that, by using compressed air instead of air, a large output may be obtained by energy of compressed air and thermal energy of combustion gas.

Several methods of adjusting the output in such a gas combustion type driving tool are proposed.

For example, JP-A-S50-15177 discloses a method of adjusting output of a gas combustion type driving tool, in which an operation timing of a valve is changed by adjusting pressure operating on a member (the valve) provided between a combustion chamber and a cylinder.

JP-A-S63-28574 discloses a method of adjusting output of a gas combustion type driving tool by changing a volume of a combustion chamber.

There is also a method of adjusting output of a gas combustion type driving tool by using a known driving depth adjustment mechanism.

SUMMARY OF INVENTION

Problems to be Solved by Invention

In a configuration disclosed in JP-A-S50-15177, it is difficult to adjust the output as the operation timing of the valve and the output are not in a linear relationship. There is also a problem of wasting fuel as it is necessary to operate the valve at a timing of low energy conversion efficiency in order to lower the output.

In a configuration disclosed in JP-A-S63-28574, there is a problem of a complicated structure as a structure for locking a piston is necessary so as to change the volume of the combustion chamber.

In the method of using a driving depth adjusting mechanism, there is a problem of wasting fuel and a heavy load on a bumper or the tool as surplus energy is absorbed by the bumper or the like.

Therefore, an object of the present invention is to provide a gas combustion type driving tool capable of accurately adjusting output with a simple structure.

Means for Solving Problems

In order to solve the above-described problems, the present invention provides a gas combustion type driving tool that drives a fastener by combustion pressure when mixed gas of combustible gas and compressed air in a combustion chamber is ignited. The gas combustion type driving tool includes an air ejection valve, and a gas ejection valve. The air ejection valve is configured to eject compressed air into the combustion chamber. The gas ejection valve is configured to eject combustible gas into the combustion chamber. Output related to driving of a fastener is adjustable by adjusting at least one of filling pressure of compressed air or filling pressure of combustible gas.

Effect of Invention

As described above, the gas combustion type driving tool includes the air ejection valve that ejects compressed air into the combustion chamber and the gas ejection valve that ejects combustible gas into the combustion chamber. The output related to driving of a fastener can be adjusted by adjusting at least one of the filling pressure of compressed air or the filling pressure of combustible gas. According to such a configuration, filling pressure of the mixed fuel container be changed by adjusting at least one of the filling pressure of the compressed air or the filling pressure of the combustible gas. The output can be accurately adjusted as filling pressure and output energy of the mixed gas are in a proportional relation. Fuel is not wasted as the combustible fuel container be burned with highest energy efficiency even in any output setting. Further, a simple structure can be obtained as there is no need for a structure that mechanically adjusts the output.

Setting of the filling pressure of the mixed fuel container be manually changed by a user of the gas combustion type driving tool, or be automatically changed based on input from a sensor or the like.

DESCRIPTION OF EMBODIMENTS

Figure 1:
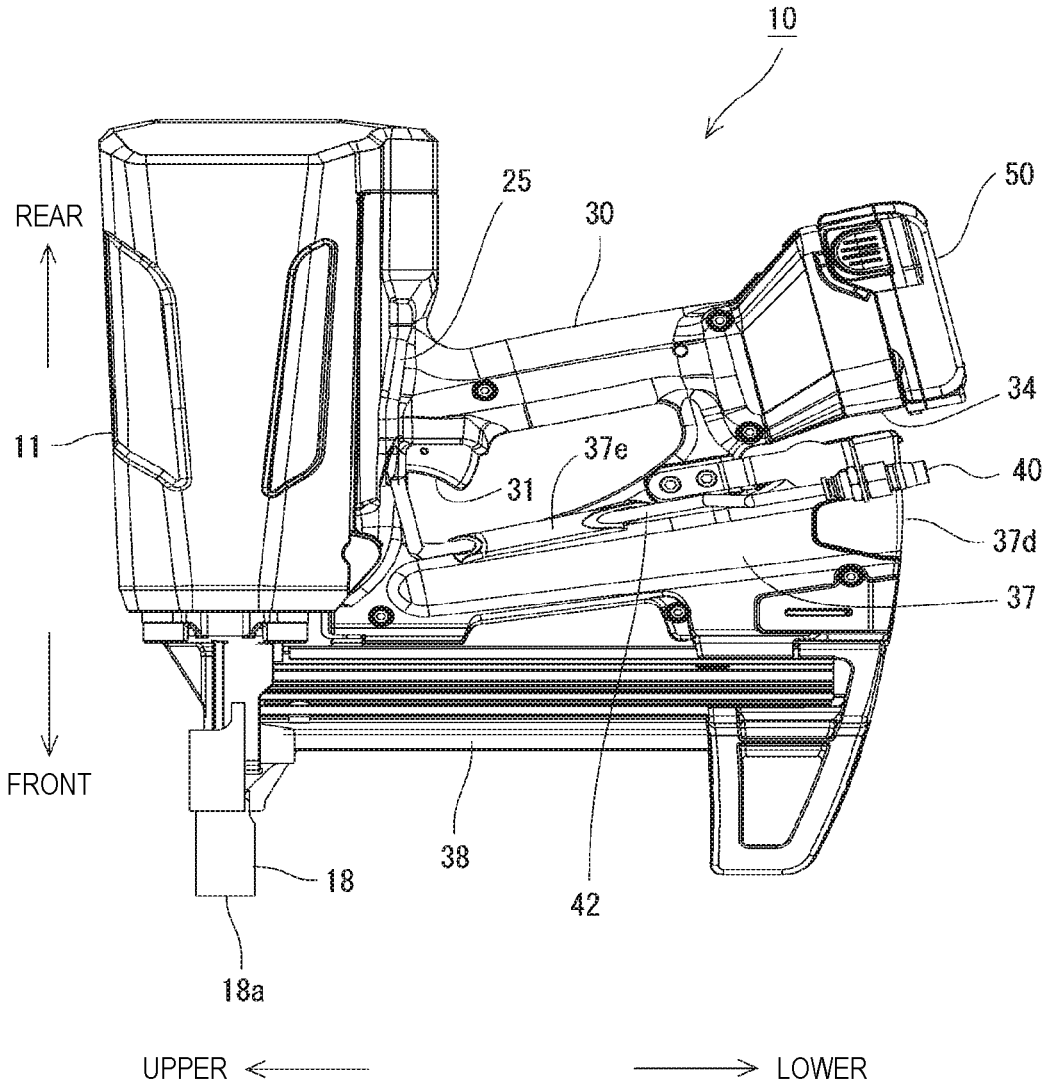
FIG. 1 is a side view of a gas combustion type driving tool.

Embodiments of the present invention are described with reference to the drawings. In the following description, as illustrated in FIG. 1, a direction in which a fastener is driven out is described as "front", and an opposite direction is described as "rear". When viewed in a direction orthogonal to the direction in which a fastener is driven out, that is, in a direction in which a grip 30 is extended, a direction in which an output unit 11 is located is described as "upper" and an opposite direction is described as "lower".

Figure 2:
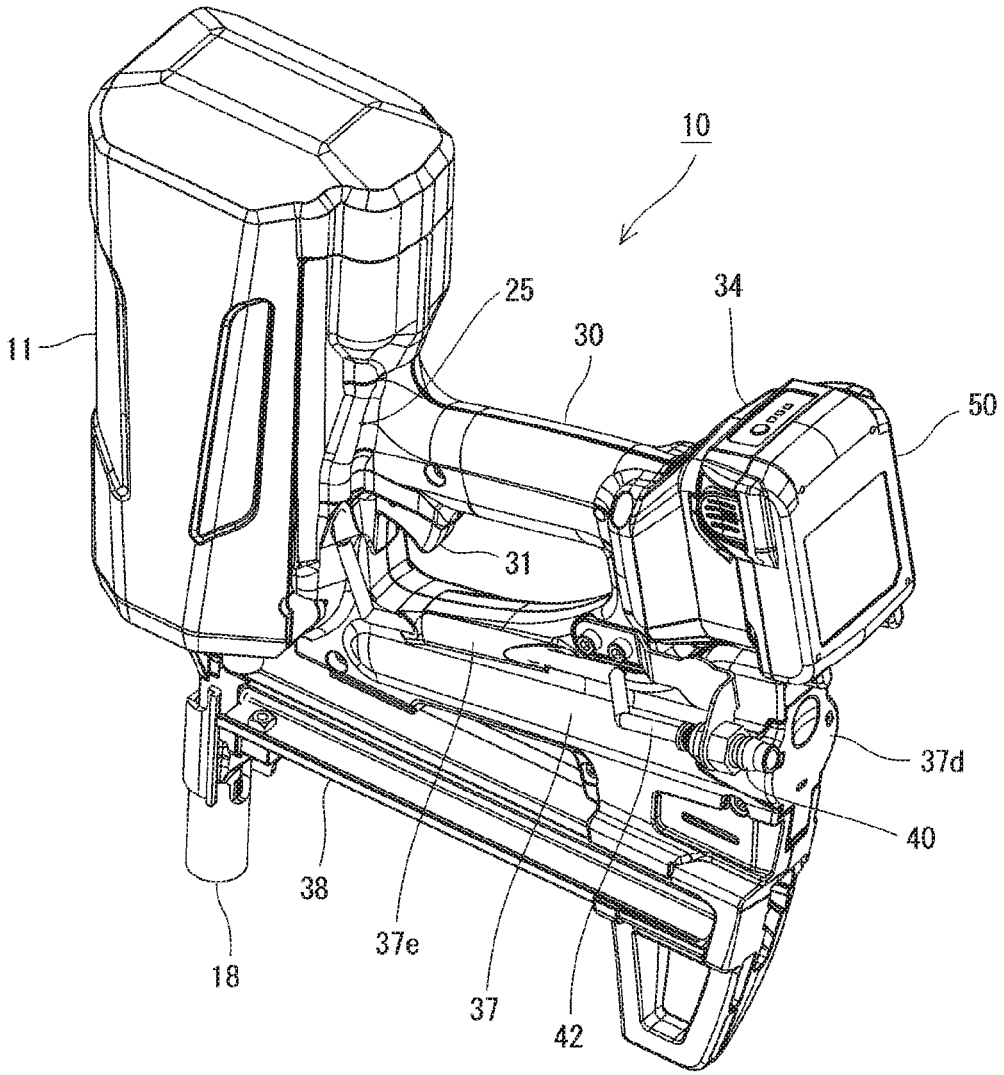
FIG. 2 is a perspective view of the gas combustion type driving tool.

A gas combustion type driving tool 10 according to the present embodiment drives a fastener out by combustion pressure when mixed gas of combustible gas and compressed air is ignited. As illustrated in FIGS. 1 and 2, the gas combustion type driving tool 10 includes the output unit 11, the grip 30, a fuel container storage unit 37, a magazine 38, and a coupler 40.

Figure 3:
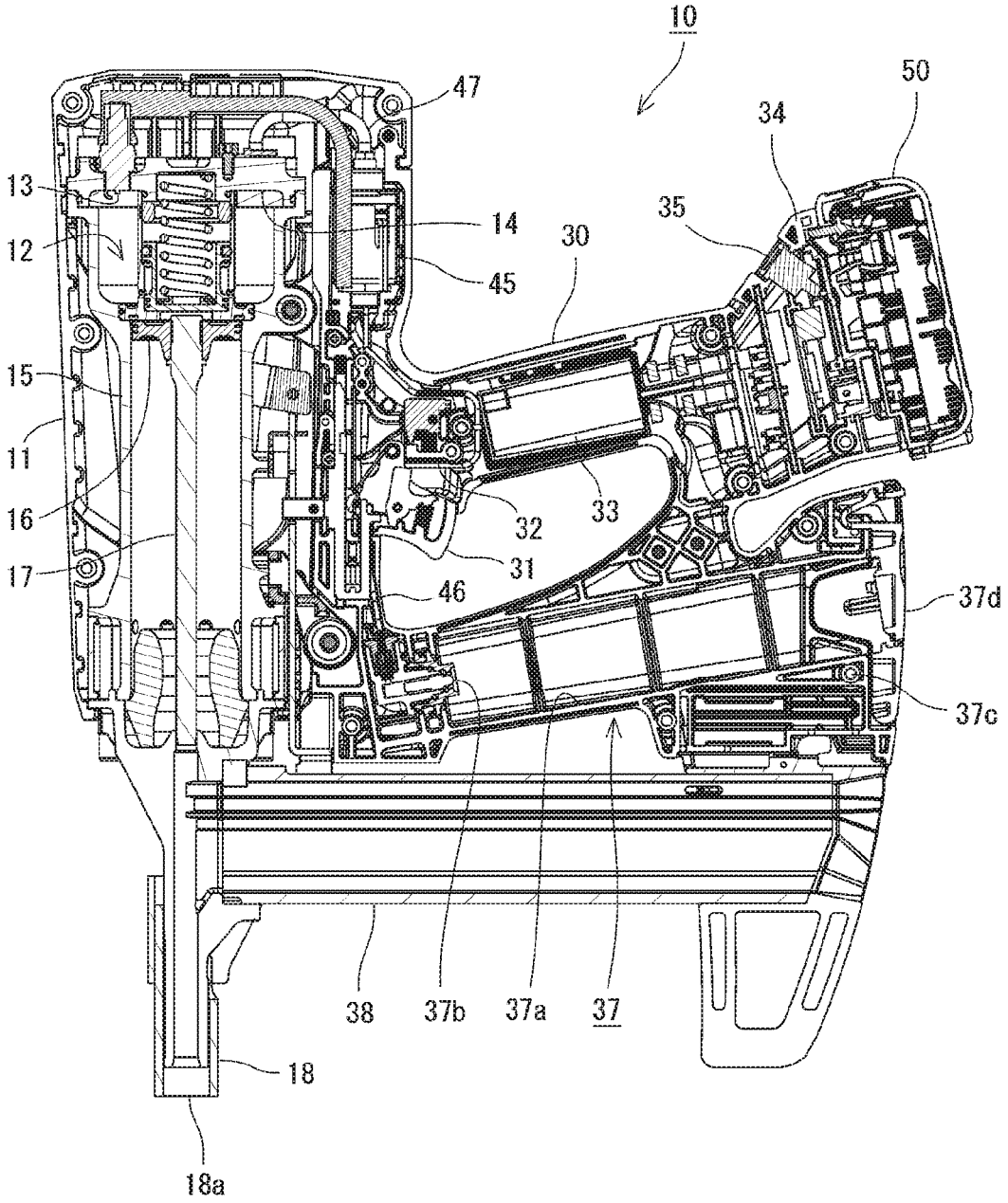
FIG. 3 is a side cross-sectional view of the gas combustion type driving tool.
Figure 4:
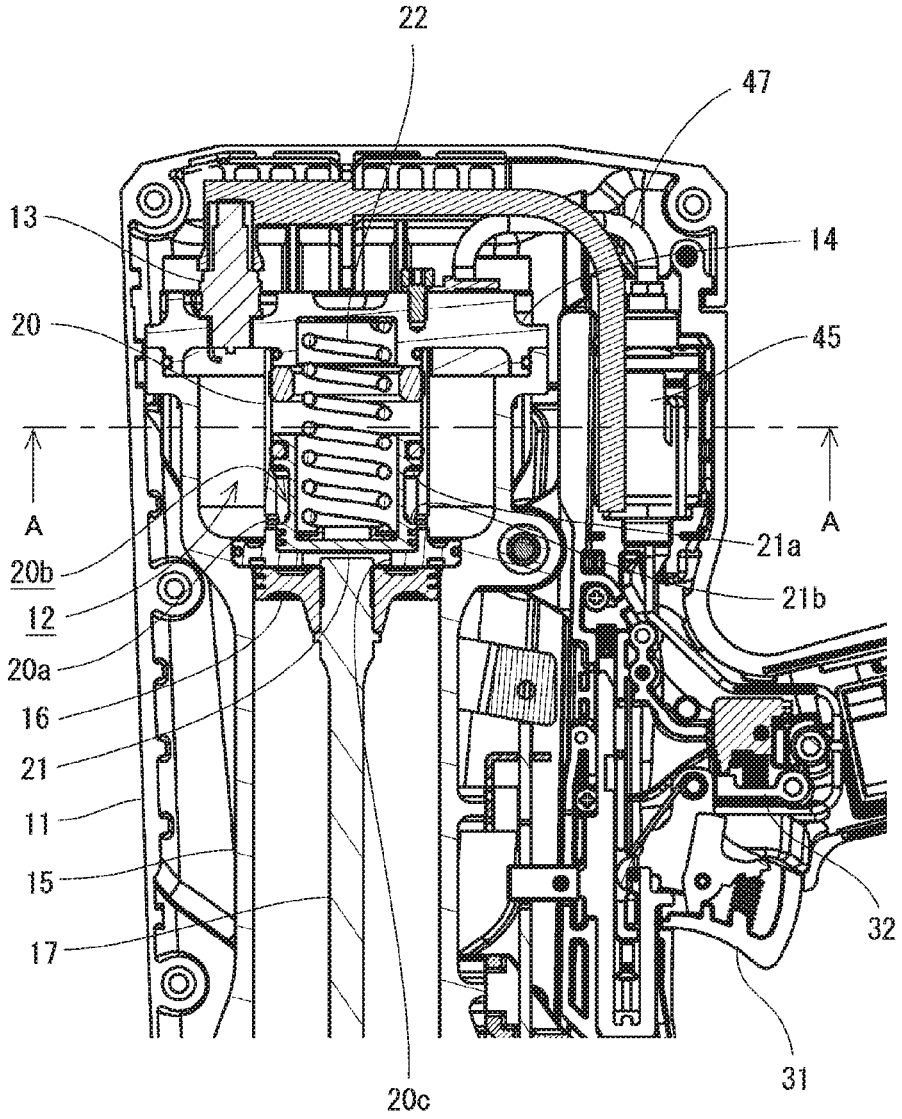
FIG. 4 is an enlarged partial side sectional view of the gas combustion type driving tool.

As illustrated in FIGS. 3 and 4, the output unit 11 includes a combustion chamber 12. The combustion chamber 12 is a space for burning combustible gas and is used as a space that can be sealed in rear (the direction opposite to the direction in which a fastener is driven out) of a piston 16 to be described below. Combustion pressure generated in the combustion chamber 12 is used to drive out a fastener by operating on the piston 16.

At a front end of the output unit 11, a nose portion 18 is attached to guide a fastener to a workpiece. When a driving operation is performed by operating a trigger operating unit 31 to be described below, the fastener is driven to the workpiece from an ejection outlet 18*a*. The ejection outlet 18*a* opens to a front end of the nose portion 18.

The nose portion 18 can be pushed into the output unit 11, and the driving operation is not performed even if the trigger operating unit 31 is operated, unless the nose portion 18 is pushed in. Specifically, a safety switch (not illustrated) is turned on by pushing in the nose portion 18, and a signal of a trigger switch 32 to be described below is not enabled unless the safety switch is turned on. Therefore, the fastener is not driven out unless the nose portion 18 is pressed against the workpiece, so that safety is ensured.

As illustrated in FIG. 4 and the like, the output unit 11 houses, inside a housing thereof, an ignition device 13, a cylinder head 14, a cylinder 15, a piston 16, a driver 17, a cylindrical member 20, a movable plug 21, a compression spring 22, and the like.

The ignition device 13 is used to generate a spark inside the combustion chamber 12. For example, the ignition device 13 is a spark plug that generates a spark by raising a voltage of a battery pack 50 to be described below to a high voltage and discharging the high voltage. The ignition device 13 performs an ignition operation at a predetermined timing based on a signal from a control device 33 to be described below. When the ignition device 13 ignites the mixed gas in the combustion chamber 12, a high-pressure combustion gas is generated in the combustion chamber 12, so that the piston 16 to be described below slides in an impacted manner by combustion pressure thus generated.

The cylinder head 14 constitutes the combustion chamber 12 together with the cylinder 15 to be described below. The cylinder head 14 is fixed to close a rear end of the cylinder 15. The cylinder head 14 is provided with an air ejection unit 44 and a gas ejection unit 48 to be described below, so that compressed air and combustible fuel container be introduced into the combustion chamber 12 from the air ejection unit 44 and the gas ejection unit 48.

The cylinder 15 is disposed in a longitudinal direction of the output unit 11. The cylinder 15 has two spaces in the front and rear. The space in the front guides the piston 16 to be described below to be slidable therein. The space in the rear constitutes the combustion chamber 12. The two spaces in the front and rear are connected with each other, and the cylindrical member 20 to be described below is attached between the two spaces. The front and rear two spaces can be shielded by the movable plug 21 housed in the cylindrical member 20.

The piston 16 is slidably housed inside the cylinder 15. When the high-pressure combustion gas is generated in the combustion chamber 12, the combustion gas operates on the piston 16, so that the piston 16 is actuated forward.

The driver 17 is used to hit a fastener and is coupled to front of the piston 16. When the driving operation is performed, the driver 17 slides along an ejection path of the fastener and drives the fastener in the ejection path out of the ejection outlet 18*a*.

The cylindrical member 20 is fixed to the cylinder 15 in the combustion chamber 12. The cylindrical member 20 includes a pressure chamber 20*b* therein that actuates the movable plug 21 to be described below. On a side portion of the cylindrical member 20, a first opening 20*a* is provided to connect the combustion chamber 12 and the pressure chamber 20*b*. On an end surface of the cylindrical member 20 facing the piston 16, a second opening 20*c* is provided to connect the combustion chamber 12 and a space in rear of the piston 16.

The movable plug 21 is a columnar member slidably disposed inside the cylindrical member 20. The movable plug 21 is biased in a direction toward the piston 16 by the compression spring 22, and closes the second opening 20*c* when in a natural state. Therefore, the combustion chamber 12 and the space in rear of the piston 16 are shielded by the movable plug 21 before the driving operation, resulting in a sealed space in the combustion chamber 12.

The movable plug 21 includes a groove in an outer periphery thereof, so that the pressure chamber 20*b* is defined between the groove and an inner peripheral surface of the cylindrical member 20. The pressure chamber 20*b* is connected with the combustion chamber 12 when in a natural state, resulting in the same air pressure as air pressure in the combustion chamber 12. The groove of the movable plug 21 includes a first pressure receiving surface 21*a* and a second pressure receiving surface 21*b* respectively in upper and lower edges of the groove to receive air pressure in the pressure chamber 20*b*. In the present embodiment, the first pressure receiving surface 21*a* has an area larger than an area of the second pressure receiving surface 21*b*, so that the movable plug 21 is actuated by a difference in pressure receiving areas. That is, when the air pressure in the pressure chamber 20*b* is increased, a force acts to slide the movable plug 21 in a direction away from the piston 16. The movable plug 21 slides rearward when the force overcomes a biasing force of the compression spring 22.

Therefore, the movable plug 21 slides to open the second opening 20*c* when the air pressure in the pressure chamber 20*b* (that is, the combustion chamber 12) exceeds a certain level. When the second opening 20*c* is opened, the combustion chamber 12 is connected with the space in rear of the piston 16, so that a (combustion gas) in the combustion chamber 12 flows into rear of the piston 16. Specifically, when the combustible gas burns in the combustion chamber 12 and pressure in the combustion chamber 12 increases, the movable plug 21 slides such that the combustion gas is allowed to flow into rear of the piston 16, and the piston 16 is driven by combustion pressure.

The grip 30 is connected to a lower surface of the output unit 11, and is substantially orthogonal to the direction in which a fastener is driven out. A user of the gas combustion type driving tool 10 can hold the tool stably by gripping the grip 30.

The grip 30 is provided with the trigger operating unit 31 that can be pulled. The trigger operating unit 31 is disposed at such a position that an index finger is applied to the trigger operating unit 31 when the grip 30 is gripped. When the trigger operating unit 31 is operated, the trigger switch 32 inside the grip 30 is pressed and turned on. A signal output from the trigger switch 32 turned on is transmitted to and processed by the control device 33 inside the grip 30. Specifically, when both the safety switch and the trigger switch 32 are turned ON, the control device 33 performs a predetermined driving operation (details of the driving operation is described below).

On a lower end surface of the grip 30, a battery mounting unit 34 is provided, to which a battery pack 50 can be detachably attached. The gas combustion type driving tool 10 according to the present embodiment is driven by electric power supplied from the battery pack 50 having a built-in secondary battery. Accordingly, the gas combustion type driving tool 10 is used in a state in which the battery pack 50 is mounted on the battery mounting unit 34. In the present embodiment, the battery pack 50 can be mounted on the battery mounting unit 34 by being slid from rear. The battery pack 50 can also be detached from the battery mounting unit 34 by being slid rearward.

The fuel container storage unit 37 is used for mounting a fuel container that is a supply source of combustible gas to be supplied to the combustion chamber 12. As illustrated in FIG. 3, the fuel container storage unit 37 according to the present embodiment is of a cylindrical shape and is disposed in front of the grip 30. A central axis of the fuel container storage unit 37 is substantially parallel to the grip 30.

The fuel container storage unit 37 according to the present embodiment includes a cylindrical portion 37*a* in which a fuel container is held in a slidable manner, a connection portion 37*b* disposed at an innermost portion of the cylindrical portion 37*a*, and a lid 37*d* disposed in the front of the cylindrical portion 37*a*.

The connection portion 37*b* connects a nozzle of a fuel container. The connection portion 37*b* is connected to a first gas pipe 46 to be described below. By connecting the nozzle of a fuel container to the connection portion 37*b*, combustible gas in the connected fuel container can be guided to the combustion chamber 12.

The lid 37*d* is attached to the fuel container storage unit 37 and can be opened and closed. Specifically, the lid 37*d* is rotatably supported by the fuel container storage unit 37 via a hinge 37*c*, so that inside of the fuel container storage unit 37 can be opened or sealed by rotating the lid 37*d*. By opening the lid 37*d*, a fuel container stored in the fuel container storage unit 37 can be taken out, and a fuel container can also be inserted into the fuel container storage unit 37.

The magazine 38 is used for loading a plurality of fasteners those can be driven out, and is connected to a lower side of the nose portion 18. The fasteners loaded in the magazine 38 are sequentially supplied to the nose portion 18, in which a leading fastener supplied to the nose portion 18 is hit and driven out by the driver 17. The magazine 38 according to the present embodiment allows connected fasteners to be aligned in a straight line.

The coupler 40 connects, for example, a plug of a hose that is connected to an air supply source such as an air compressor, and is used for taking in compressed air from outside. The coupler 40 is disposed on a lower end side of the grip 30, and particularly at a position lower than the grip 30 that can be gripped by the user. Further, the coupler 40 is opened downward. The gas combustion type driving tool 10 according to the present embodiment is used for driving fasteners by transmitting the compressed air supplied from outside to the combustion chamber 12 through the coupler 40.

As illustrated in FIG. 2, the coupler 40 is provided at a position shifted to a side (left side as viewed from a user holding the grip 30) of the grip 30 as viewed with respect to the grip 30. Specifically, the coupler 40 is on a lateral side of the fuel container storage unit 37. Further, the coupler 40 is shifted forward from the battery mounting unit 34. In this manner, the coupler 40 is shifted from and close to the battery mounting unit 34 and the fuel container storage unit 37, so as not to interfere with the battery mounting unit 34 and the fuel container storage unit 37. Therefore, parts requiring attachment/detachment such as the battery mounting unit 34, the fuel container storage unit 37, and the coupler 40 are collectively disposed on the lower end side of the grip 30, resulting in good operability. Since the battery mounting unit 34, the fuel container storage unit 37, and the coupler 40 are arranged in a compact manner, the gas combustion type driving tool 10 is not large in size and is easy to handle.

As illustrated in FIG. 1, the coupler 40 does not protrude downward relative to the battery pack 50 mounted on the battery mounting unit 34. Therefore, the coupler 40 does not protrude beyond an outline of the gas combustion type driving tool 10, resulting in good operability of the tool when a hose is connected to the coupler 40. With the coupler 40 within the outline of the tool, the coupler 40 is less likely to come into contact with ground when the tool is placed on the ground or the like, so that dust or the like is less likely to adhere to the coupler 40.

Next, an introduction path of compressed air and combustible gas into the combustion chamber 12 is described.

The compressed air supplied from outside is introduced into the tool through the coupler 40 as described above. The gas combustion type driving tool 10 according to the present embodiment includes a pipe for connecting the coupler 40 and the combustion chamber 12. Specifically, the gas combustion type driving tool 10 includes a first air pipe 42 constituting an introduction path from the coupler 40 to an air ejection valve 41 (described below) and a second air pipe 43 constituting an introduction path from the air ejection valve 41 to the combustion chamber 12.

Figure 8:
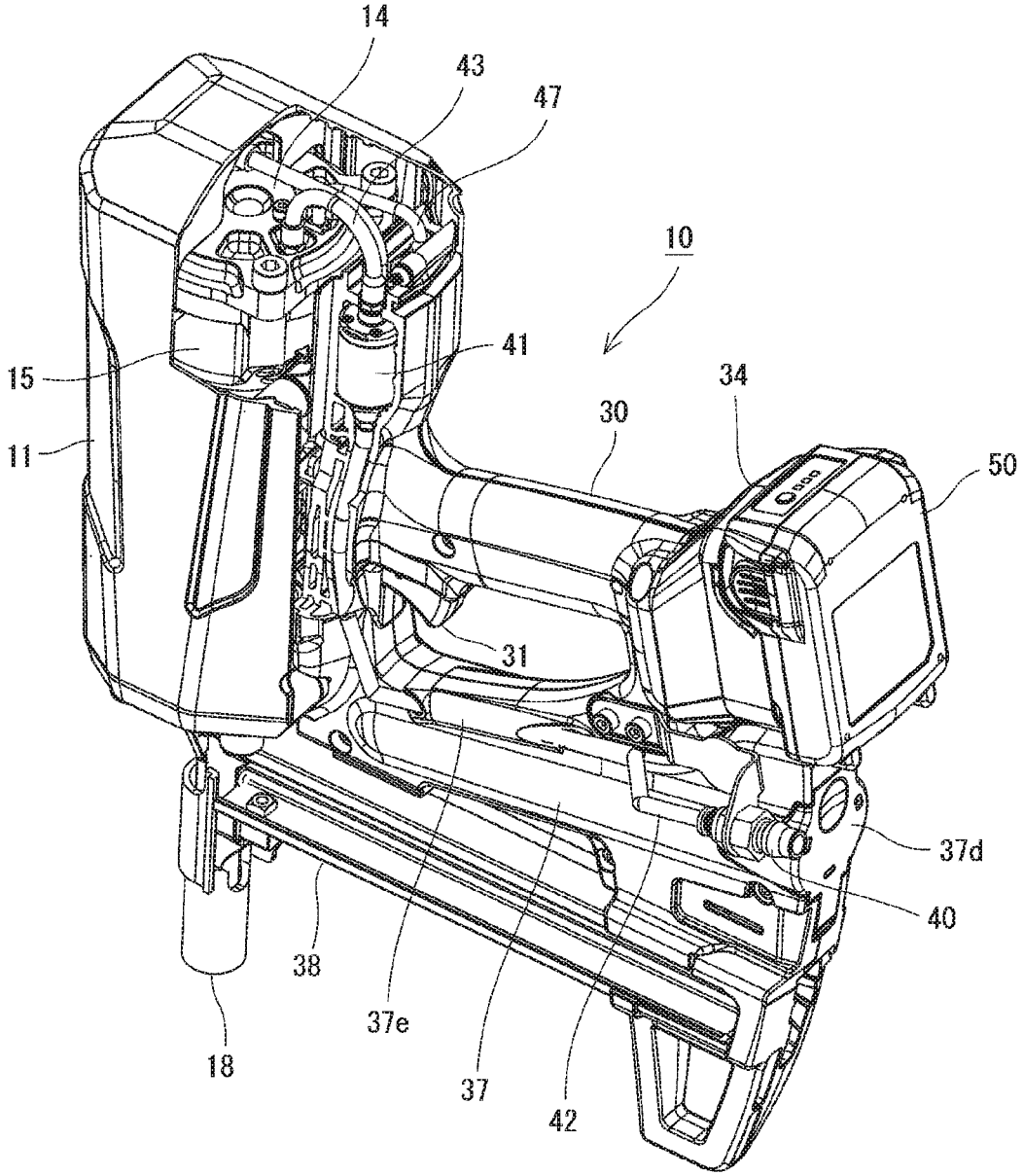
FIG. 8 is a perspective view illustrating an internal structure of the gas combustion type driving tool.

The first air pipe 42 has an upstream end connected to the coupler 40 and a downstream end connected to the air ejection valve 41. As illustrated in FIGS. 1 and 8, an upstream side of the first air pipe 42 is disposed along a lateral surface of the fuel container storage unit 37. A downstream side of the first air pipe 42 is disposed along a lateral surface of the output unit 11. The fuel container storage unit 37 and the output unit 11 are connected in a substantially L shape. Accordingly, the first air pipe 42 is bent into an L shape at a connection position of the fuel container storage unit 37 and the output unit 11. The first air pipe 42 according to the present embodiment is formed of an elastically bendable tube.

A part of the first air pipe 42 is exposed outside a housing of the tool. Specifically, the first air pipe 42 passes through a tunnel-shaped pipe holding unit 37*e* on the lateral surface of the fuel container storage unit 37 and is inserted into a pipe cover unit 25 on the lateral surface of the output unit 11, other parts of the first air pipe being exposed outside. According to such a configuration, the first air pipe 42 is inserted and assembled to the tool from outside of the housing, resulting in good assembling properties.

Figure 6:
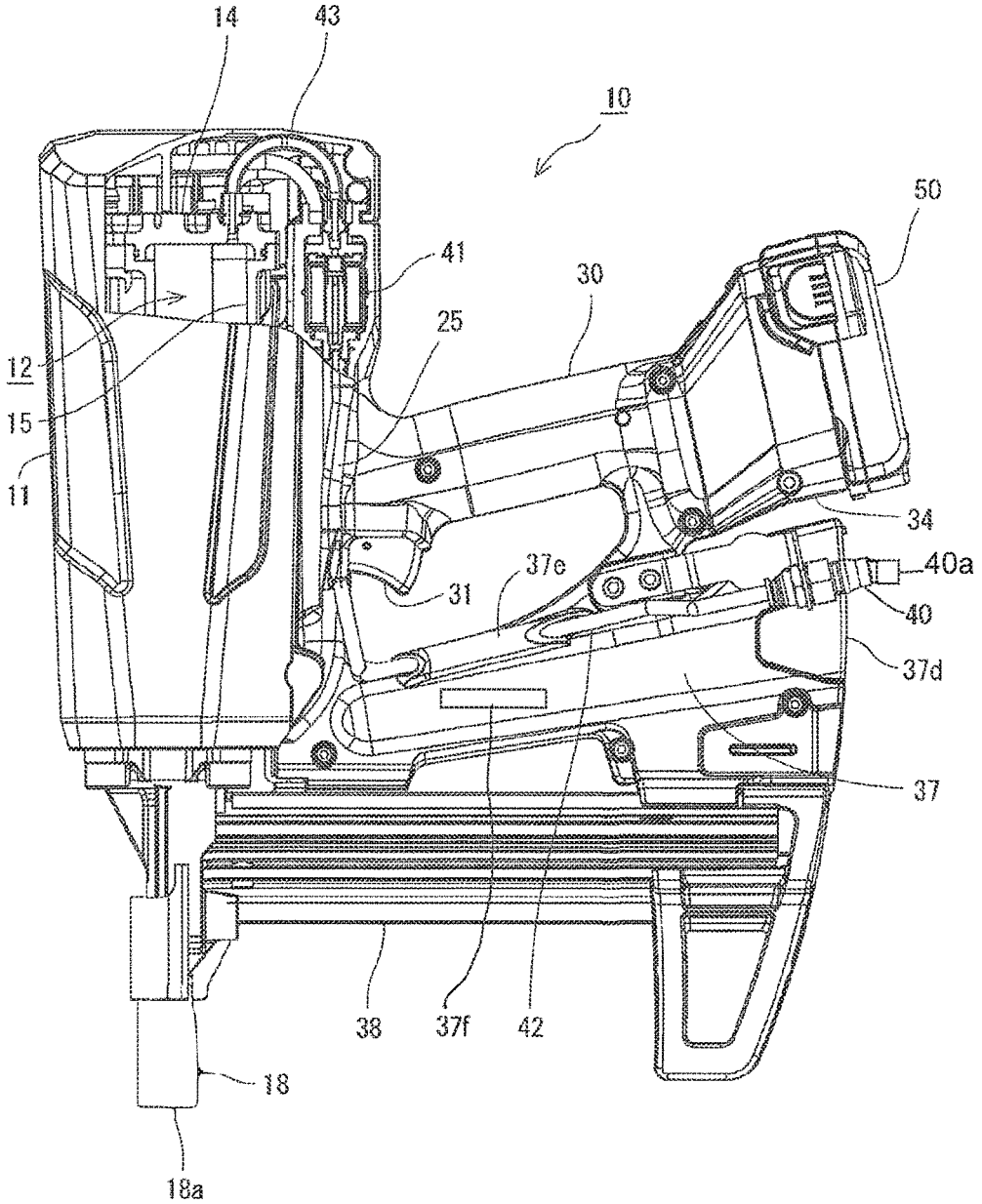
FIG. 6 is a side view (partial sectional view taken along a line B-B) of the gas combustion type driving tool.

The air ejection valve 41 is an electromagnetic valve that controls an amount of compressed air supplied to the combustion chamber 12. The air ejection valve 41 measures the compressed air supplied through the first air pipe 42, and ejects a certain amount of the compressed air into the combustion chamber 12. As illustrated in FIG. 6, the air ejection valve 41 according to the present embodiment is adjacent to the combustion chamber 12. Therefore, a distance of the second air pipe 43 to be described below can be short, making it possible to improve a response of the tool.

Figure 5:
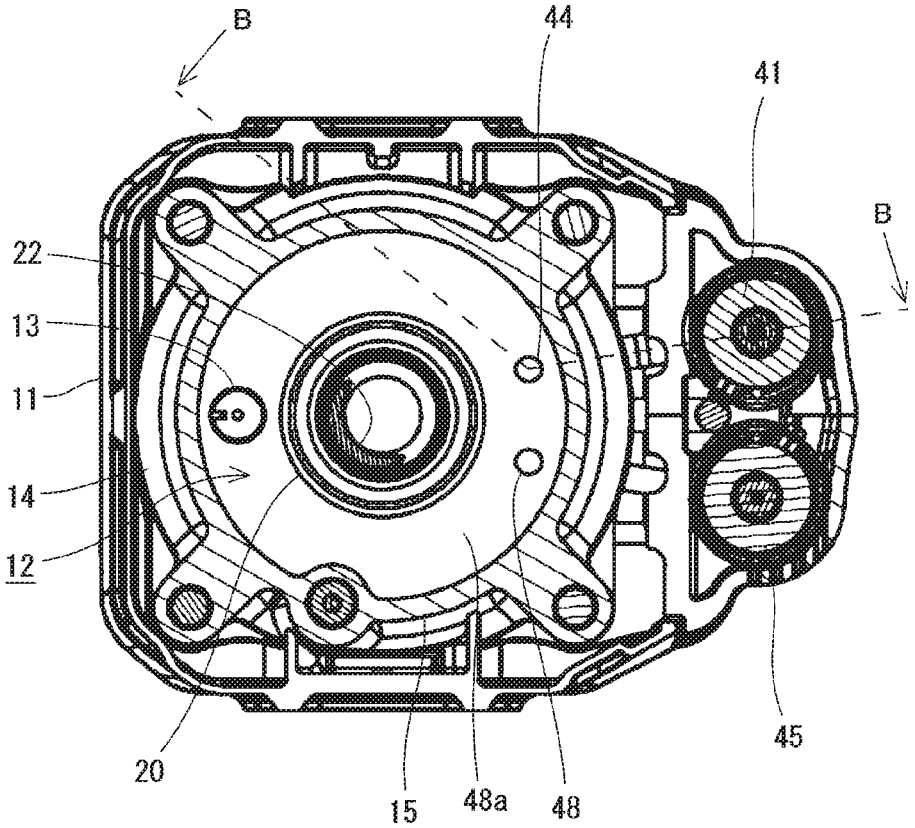
FIG. 5 is a cross-sectional view taken along a line A-A of the gas combustion type driving tool.
Figure 7:
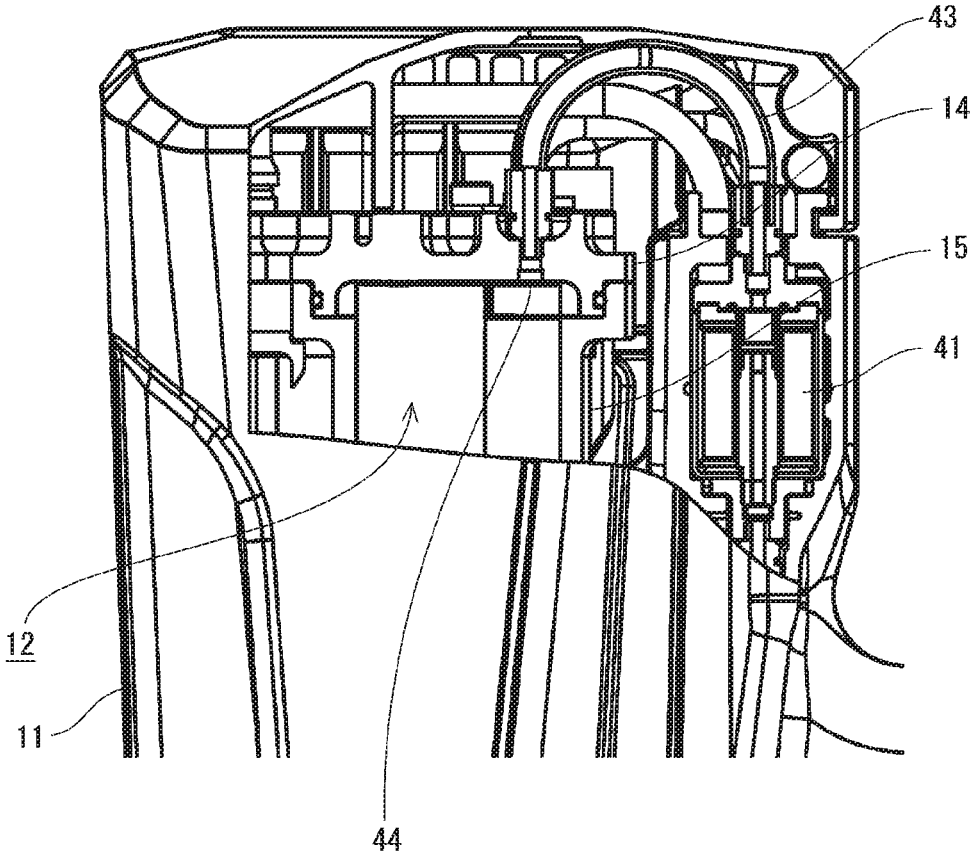
FIG. 7 is an enlarged side view (partial sectional view taken along the line B-B) of the gas combustion type driving tool.

The second air pipe 43 has an upstream end connected to the air ejection valve 41 and a downstream end connected to the combustion chamber 12. The second air pipe 43 is used for introducing the compressed air ejected by the air ejection valve 41 into the combustion chamber 12. As illustrated in FIGS. 6 and 8, the second air pipe 43 is disposed to wrap the cylinder head 14 from rear. As illustrated in FIGS. 5 and 7, the cylinder head 14 is provided with an air ejection unit 44 for connecting the second air pipe 43, so that the compressed air passing through the second air pipe 43 flows into the combustion chamber 12 through the air ejection unit 44.

The second air pipe 43 according to the present embodiment is formed of an elastically bendable tube. Accordingly, the second air pipe 43 is less likely to break or come off even when vibration and shocks occur during the driving operation.

As described above, combustible gas in the fuel container is introduced through the connection portion 37*b* of the fuel container storage unit 37. The gas combustion type driving tool 10 according to the present embodiment includes a pipe for connecting the connection portion 37*b* and the combustion chamber 12. Specifically, the gas combustion type driving tool 10 includes a first gas pipe 46 constituting an introduction path from the connection portion 37*b* to a gas ejection valve 45 (described below), and a second gas pipe 47 constituting an introduction path from the gas ejection valve 45 to the combustion chamber 12.

The first gas pipe 46 has an upstream end connected to the connection portion 37*b*, and a downstream end connected to the gas ejection valve 45. As illustrated in FIG. 3, the first gas pipe 46 is disposed along the output unit 11.

The gas ejection valve 45 is an electromagnetic valve that controls an amount of combustible gas supplied to the combustion chamber 12. The gas ejection valve 45 measures the combustible gas supplied through the first gas pipe 46, and ejects a certain amount of the combustible gas into the combustion chamber 12. As illustrated in FIG. 4, the gas ejection valve 45 according to the present embodiment is adjacent to the combustion chamber L. Therefore, a distance of the second gas pipe 47 to be described below can be short, making it possible to improve a response of the tool.

The second gas pipe 47 has an upstream end connected to the gas ejection valve 45, and a downstream end connected to the combustion chamber 12. The second gas pipe 47 is used for introducing the combustible gas ejected by the gas ejection valve 45 into the combustion chamber 12. As illustrated in FIGS. 4 and 8, the second gas pipe 47 is disposed to wrap the cylinder head 14 from rear. As illustrated in FIG. 5, the cylinder head 14 is provided with a gas ejection unit 48 for connecting the second gas pipe 47, so that the combustible gas passing through the second gas pipe 47 flows into the combustion chamber 12 through the gas ejection unit 48. The second gas pipe 47 according to the present embodiment is formed of an elastically bendable tube. Accordingly, the second gas pipe 47 is less likely to break or come off even when vibration and shocks occur during the driving operation.

Next, a driving operation of the gas combustion type driving tool 10 according to the present embodiment is described with reference to FIG. 9.

Figures 9, 10:
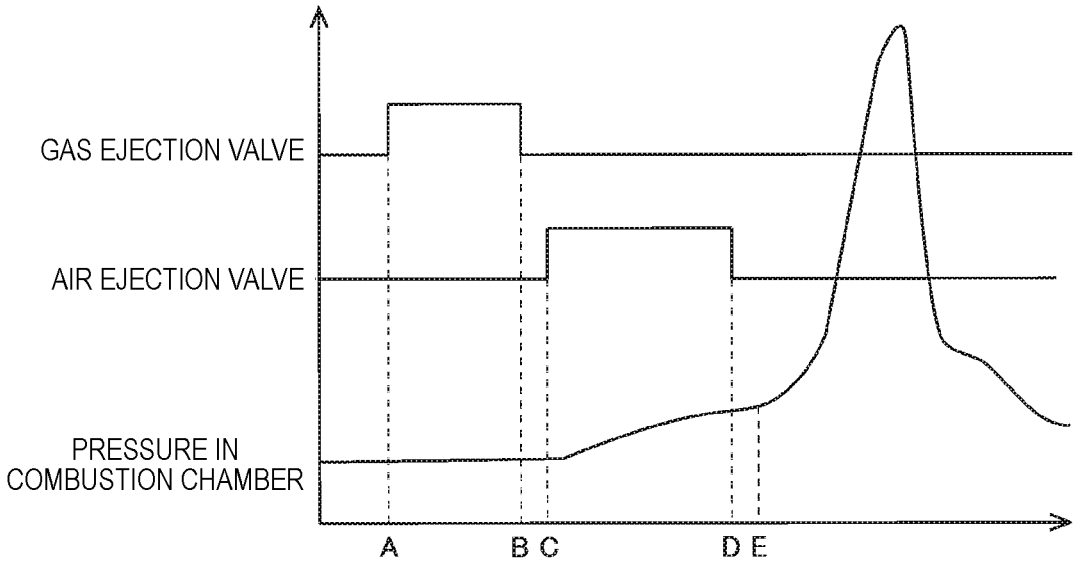
FIG. 9 is a timing chart showing operation of the gas combustion type driving tool.
FIG. 10 is a table showing examples of output settings.

When the trigger operating unit 31 is operated to start the driving operation, the control device 33 first opens the gas ejection valve 45 at a timing indicated by A in FIG. 9. The gas ejection valve 45 is opened for a predetermined time, and is closed at a timing indicated by B when the predetermined time elapses. Accordingly, a predetermined amount of combustible gas is supplied into the combustion chamber 12.

Next, the control device 33 opens the air ejection valve 41 at a timing indicated by C in FIG. 9. The air ejection valve 41 is opened for a predetermined time, and is closed at a timing indicated by D when the predetermined time elapses. Accordingly, a predetermined amount of compressed air is supplied into the combustion chamber 12.

When the combustible gas and the compressed air are introduced into the combustion chamber 12 to form mixed gas, the control device 33 operates the ignition device 13 at a timing indicated by E in FIG. 9 to ignite the mixed gas. Accordingly, pressure in the combustion chamber 12 is rapidly increased. When the pressure in the combustion chamber 12 is increased, the movable plug 21 is activated, so that the combustion gas flows into rear of the piston 16. Accordingly, the combustion pressure makes the piston 16 slide by operating on the piston 16, so that a fastener is driven out by the driver 17 that slides integrally with the piston 16.

In the gas combustion type driving tool 10 according to the present embodiment, output related to driving of a fastener can be adjusted by adjusting filling pressure of compressed air and filling pressure of combustible gas in the combustion chamber 12. Specifically, the output is adjusted by adjusting opening time of the air ejection valve 41 and opening time of the gas ejection valve 45. The adjustment of the opening time of the air ejection valve 41 and the opening time of the gas ejection valve 45 is realized by changing energizing time of the air ejection valve 41 and energizing time of the gas ejection valve 45 through the control device 33.

In the present embodiment, the user of the gas combustion type driving tool 10 can set the output in multiple stages. For example, as shown in FIG. 10, the output can be selected from three stages of "high", "medium", and "low". The gas combustion type driving tool 10 according to the present embodiment includes an operation unit 35 (see FIG. 3) such as a button or a knob for changing the output, so that an external parameter based on a user input is obtained by operating the operation unit 35. The output is adjusted by referring to the external parameter.

In the present embodiment, "medium" is a normal output, and the opening time of the air ejection valve 41 and the opening time of the gas ejection valve 45 when set to "medium" are "1" as a reference value. When set to "high", the opening time of the air ejection valve 41 and the opening time of the gas ejection valve 45 are 1.2 times of a value in "medium", which is "1.2". When set to "low", the opening time of the air ejection valve 41 and the opening time of the gas ejection valve 45 are 0.7 times of the value in "medium", which is "0.7". In this manner, in the present embodiment, both the opening time of the air ejection valve 41 and the opening time of the gas ejection valve 45 increase in proportion to the output. In the present embodiment, a ratio between the opening time of the air ejection valve 41 and the opening time of the gas ejection valve 45 is constant regardless of the output. However, the present invention is not limited thereto, and the ratio may be arbitrarily set in accordance with the set output.

In the driving operation shown in FIG. 9, the opening time of the air ejection valve 41 and the opening time of the gas ejection valve 45 determined in this manner are used for control by the control device 33. That is, after opening the gas ejection valve 45 at the timing indicated by A in FIG. 9, the control device 33 waits until the determined opening time of the gas ejection valve 45 elapses, and closes the gas ejection valve 45 at the timing indicated by B after the opening time elapses. After opening the air ejection valve 41 at the timing indicated by C in FIG. 9, the control device 33 waits until the opening time of the air ejection valve 41 elapses, and closes the air ejection valve 41 at the timing indicated by D in FIG. 9 after the opening time elapses.

The output in the present embodiment can be selected from the multiple stages. However, the present invention is not limited thereto, and the output may be selected in a stepless manner.

The output in the present embodiment can be selected from three stages of "high", "medium", and "low". However, the present invention is not limited thereto, and the user may be allowed to select an "operation mode" in which output suitable for a purpose can be obtained. Further, the user can select a nail or a driving member, and output adjustment may be performed based on a parameter set in advance in accordance with the selected condition.

The opening time of the air ejection valve 41 and the opening time of the gas ejection valve 45 set by the user in accordance with the output may be further adjusted with reference to a use environment of the tool. For example, the opening time may be adjusted according to one or a plurality of obtained factors such as environment temperature, tool temperature, supply pressure of compressed air to the air ejection valve 41, supply pressure of gas fuel to the gas ejection valve 45, pressure in a pipe, pressure in the combustion chamber 12, a flow rate in a pipe, and a power supply voltage. In this manner, a stable driving force can be always obtained even in different use environments.

The present embodiment describes an example in which the user changes the output. However, the output may be automatically changed by the tool based on input from a sensor.

Figure 11:
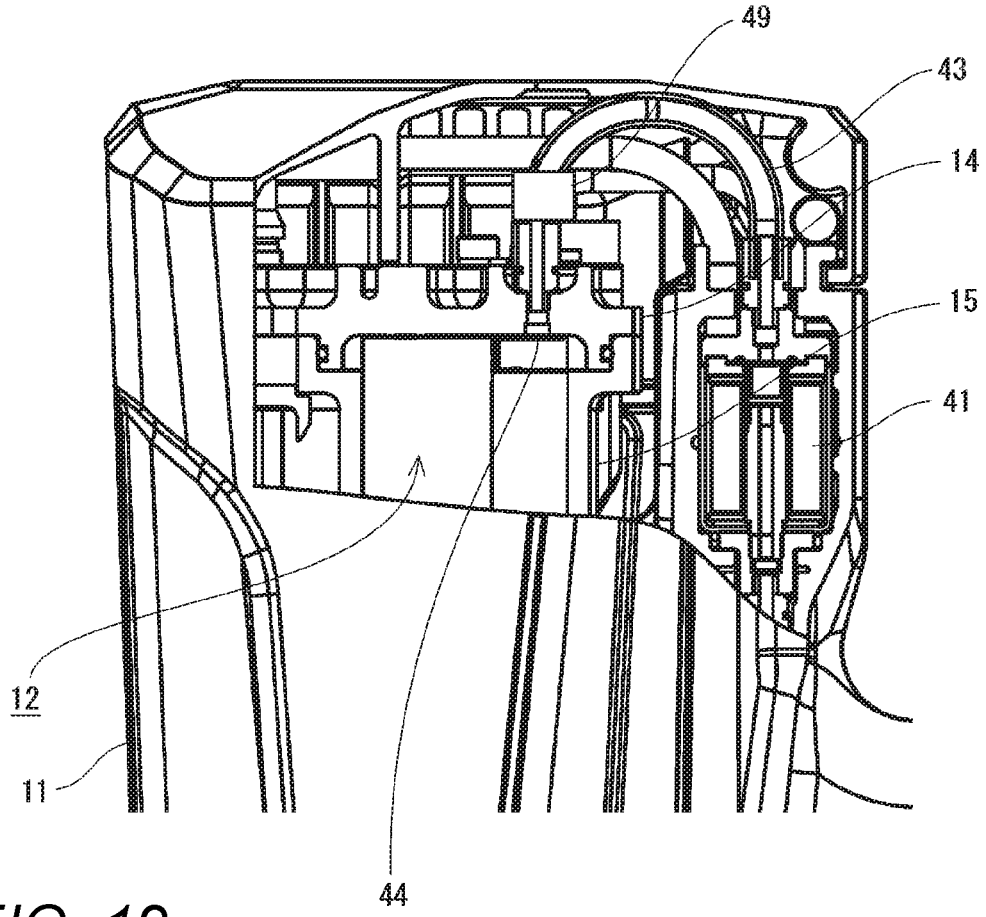
FIG. 11 is an enlarged side view of a gas combustion type driving tool according to a modification (a partial sectional view taken along a line B-B)

For example, as illustrated in FIG. 11, the tool may include a pressure sensor 49 serving as a sensor on a downstream side of the air ejection valve 41 and the gas ejection valve 45. When pressure in the combustion chamber 12 (in the pipe) detected by the pressure sensor 49 reaches a predetermined pressure, the control device 33 may close the air ejection valve 41 or the gas ejection valve 45.

In the above example, the pressure sensor 49 is provided on the downstream side of the air ejection valve 41 and the gas ejection valve 45. However, the present invention is not limited thereto, and the pressure sensor 49 may also be disposed on an upstream side of the air ejection valve 41 and the gas ejection valve 45.

The above example describes an example of the pressure sensor 49 serving as a sensor. However, in addition to or in place of the pressure sensor 49, the tool may also include a flow sensor in a flow path where the air ejection valve 41 is disposed or a flow path where the gas ejection valve 45 is disposed. When a flow rate detected by the flow sensor reaches a predetermined flow rate, the control device 33 may close the air ejection valve 41 or the gas ejection valve 45.

In addition to or in place of the pressure sensor 49 and the flow sensor, the tool may include a temperature sensor that detects environment temperature. The control device 33 may adjust the output by controlling the air ejection valve 41 or the gas ejection valve 45 using the environment temperature detected by the temperature sensor as the input parameter.

In addition to (or in place of) the above-described control, the output may also be adjusted by adjusting supply pressure to the air ejection valve 41 or the gas ejection valve 45. For example, the supply pressure may be constant as the output is not stable when the supply pressure to the air ejection valve 41 or the gas ejection valve 45 is unstable.

Specifically, the supply pressure to the gas ejection valve 45 may be adjusted by changing temperature of the fuel container which is a supply source of combustible gas. Vapor pressure of gas fuel increases with temperature, and accordingly the supply pressure to the gas ejection valve 45 also changes when the temperature of the fuel container changes. When such a change is not desired, the supply pressure to the gas ejection valve 45 can be stabilized by keeping the temperature of the fuel container storage unit 37 constant. The supply pressure to the gas ejection valve 45 can be changed by intentionally changing the temperature of the fuel container storage unit 37 with a temperature change device schematically represented at 37*f* in FIG. 2, as a heater).

Further, the supply pressure to the air ejection valve 41 may also be adjusted by using a pressure reducing valve, schematically represented by the box at 40*a*. The supply pressure to the air ejection valve 41 depends on internal pressure of a tank of an air compressor connected to outside. Accordingly, the supply pressure to the air ejection valve 41 also decreases when the internal pressure of the tank decreases due to an insufficient amount of remaining compressed air. When such a change is not desired, the supply pressure can be made constant by the pressure reducing valve when compressed air supplied from the air compressor is supplied to the air ejection valve 41 through the pressure reducing valve. The supply pressure to the air ejection valve 41 can also be changed when the pressure reducing valve is detachable. When the pressure reducing valve 40*a* is detachable, for example, a mechanism for attaching and detaching the pressure reducing valve may be provided to the coupler 40.

The output in the above-described embodiment is adjusted by adjusting the opening time of the air ejection valve 41 and the opening time of the gas ejection valve 45. However, in addition to (or in place of) this, the output may also be adjusted by adjusting an area of a flow path for supplying the compressed air or the combustible gas to the combustion chamber 12. For example, a flow rate of the compressed air or the combustible gas may be adjusted by adjusting an opening degree of the air ejection valve 41 or the gas ejection valve 45. Specifically, with the opening degree of the air ejection valve 41 or the gas ejection valve 45 capable of being adjusted, an amount of compressed air or combustible gas supplied to the combustion chamber 12 may be adjusted by adjusting the opening degree of the air ejection valve 41 or the gas ejection valve 45. Further, the flow rate of the compressed air or the combustible gas may also be adjusted by switching the flow path. Specifically, a plurality of pipes having, different areas may be provided, so that the flow rate may be adjusted in a stepwise manner by switching these pipes to connect the combustion chamber 12. Accordingly, the amount of compressed air or combustible gas supplied to the combustion chamber 12 is adjusted.

Figure 12:
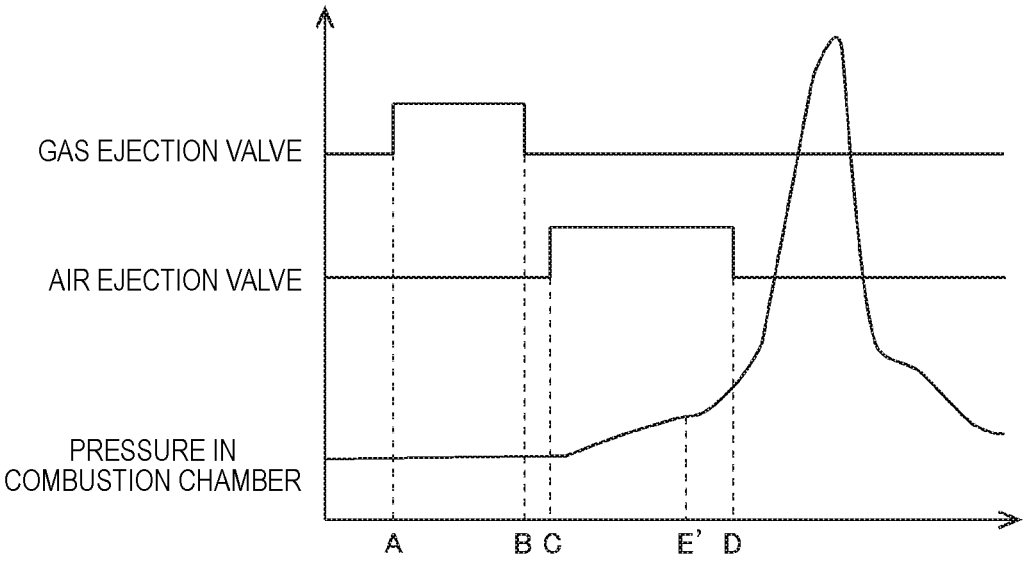
FIG. 12 is a timing chart showing operation of the gas combustion type driving tool according to the modification.

In addition to the above-described control, the output may also be adjusted by changing an ignition timing. For example, as shown in FIG. 12, by advancing the ignition timing (E'), ignition may be performed before the filling pressure in the combustion chamber 12 increases. Accordingly, the output is changed.

As described above, according to the present embodiment, the tool includes the air ejection valve 41 that ejects compressed air into the combustion chamber 12 and the gas ejection valve 45 that ejects combustible gas into the combustion chamber 12. According to such a configuration, a large output can be obtained by energy of the compressed air and thermal energy of the combustion gas even if a volume of the combustion chamber 12 is not extremely large. Specifically, output comparable to a pyrotechnic type driving tool can be obtained with a tool size in a range that can be used as a hand-held tool. Further, unlike the pyrotechnic type driving tool, the tool can be used without a special license, and maintenance is also easy.

The output related to driving of a fastener can be adjusted by adjusting at least one of the filling pressure of compressed air or the filling pressure of combustible gas. According to such a configuration, the output can be accurately adjusted as filling pressure and output energy of the mixed gas are in a proportional relation. Fuel is not wasted as the combustible fuel container be burned with highest energy efficiency even in any output setting. Further, a simple structure can be obtained as there is no need for a structure that mechanically adjusts the output.

What is claimed is:

1. A gas combustion type driving tool that drives a fastener by, combustion pressure when mixed gas of combustible gas and compressed air in a combustion chamber is ignited, the gas combustion type driving tool comprising:

an air ejection valve that is configured to eject compressed air into the combustion chamber; and a gas ejection valve that is configured to eject combustible gas into the combustion chamber, wherein output related to driving of a fastener is adjustable by adjusting opening time of the air ejection valve and opening time of the gas ejection valve to adjust filling pressure in the combustion chamber.

2. The gas combustion type driving tool according to claim 1, wherein the opening time of the air ejection valve is adjusted by changing energizing time or an amount of electric power supplied to the air ejection valve, or the opening time of the gas ejection valve is adjusted by changing energizing time or an amount of electric power supplied to the gas ejection valve.

3. The gas combustion type driving tool according to claim 1, wherein the output is adjusted by adjusting supply pressure to at least one of the air ejection valve and the gas ejection valve.

4. The gas combustion type driving tool according to claim 3, wherein supply pressure to the gas ejection valve is adjusted by changing temperature of a fuel container which is a supply source of combustible gas.

5. The gas combustion type driving tool according claim 3, wherein supply pressure to the air ejection valve is adjusted by using a pressure reducing valve.

6. The gas combustion type driving tool according to claim 1, wherein the output is adjusted by adjusting an opening degree of at least one of the air ejection valve and the gas ejection valve.

7. The gas combustion type driving tool according to claim 1, wherein the output is adjusted by referring to an external parameter based on a sensor input or a user input.

8. The gas combustion type driving tool according to claim 7, wherein the sensor includes a pressure sensor on an upstream side or a downstream side of at least one of the air ejection valve and the gas ejection valve.

9. The gas combustion type driving tool according to claim 7, wherein the sensor includes a flow sensor in a flow path disposed in at least one of the air ejection valve and the gas ejection valve.

10. The gas combustion type driving tool according to claim 7, wherein the sensor it includes a temperature sensor configured to detect environment temperature.

11. The gas combustion type driving tool according to claim 1, wherein the output is adjusted by changing a timing of the ignition.

12. The gas combustion type driving tool according to claim 1, further comprising:

an operation unit that is configured to adjust the output related to driving of a fastener.

13. The gas combustion type driving tool according to claim 1, further comprising a controller which controls the opening of the air ejection valve and the gas ejection valve.

14. The gas combustion type driving tool according to claim 13, wherein the controller controls an opening time and a closing time of each of the air ejection valve and the gas ejection valve.

* * * * *